US005088370A

United States Patent [19]

Kondo

[11] Patent Number: 5,088,370

[45] Date of Patent: Feb. 18, 1992

[54] SHEET MATERIAL CUTTING APPARATUS

[75] Inventor: Takajiro Kondo, Yonago, Japan

[73] Assignees: Hitachi Metals Ltd., Tokyo; Yasugi Seimitsu, Ltd., Yasugi, both of Japan

[21] Appl. No.: 603,379

[22] Filed: Oct. 26, 1990

[30] Foreign Application Priority Data

Nov. 10, 1989 [JP] Japan ..... 1-292892
Aug. 2, 1990 [JP] Japan ..... 2-205463

[51] Int. Cl.[5] ..... B26D 5/14

[52] U.S. Cl. ..... 83/528; 83/349; 83/602; 83/628; 241/32

[58] Field of Search ..... 83/597, 602, 604, 610, 83/612, 628, 630, 349, 58, 528; 241/32

[56] References Cited

U.S. PATENT DOCUMENTS

| | | | |
|---|---|---|---|
| 2,084,869 | 6/1937 | Rosenberg | 83/630 X |
| 3,750,510 | 8/1973 | Gabriels | 83/349 X |
| 3,867,861 | 2/1975 | Hamisch, Sr. | 83/616 X |
| 4,244,251 | 1/1981 | Iwao et al. | 83/349 |
| 4,987,811 | 1/1991 | Ikarashi et al. | 83/628 X |
| 5,001,953 | 3/1991 | Pfeiffer | 83/602 X |

FOREIGN PATENT DOCUMENTS 147491 9/1987 Japan .

*Primary Examiner*—Mark Rosenbaum
*Assistant Examiner*—Rinaldi Rada
*Attorney, Agent, or Firm*—Antonelli, Terry, Stout & Kraus

[57] ABSTRACT

A sheet material cutting apparatus in which a pair of blades comprising a movable blade and a fixed blade are arranged, and the movable blade reciprocates to cut sheets. A drive device is mounted on the cutting apparatus, which drive device includes a drive arm to actuate the movable blade and a connecting lever having a split groove for connecting the lever to the drive arm. The movable blade is driven with the aid of the connecting lever and the drive arm of the drive device. The drive of the movable blade is controlled by elasticity of the split groove in the connecting lever. When load exceeding a predetermined amount occurs at the movable blade, the split groove in the connecting lever permits the drive arm to come off.

5 Claims, 4 Drawing Sheets

SHEET MATERIAL CUTTING APPARATUS

BACKGROUND OF THE INVENTION

1. Field of the Invention

The present invention relates to a sheet material cutting apparatus for preventing a drive device which overload is mounted on the cutter of the cutting apparatus, with the cutting apparatus being used for cutting sheet materials such as, for example, recording paper and films in, for example, facsimile equipment and copying machines.

2. Description of the Prior Art

Conventional sheet cutting apparatuses, composed of reciprocating movable blades and fixed blades, are powered by motors exclusively provided for such purpose or main motors of the machines in order to transmit the power to the movable blades after the rotational movement of the motor is converted into a reciprocating movement. In such a conventional cutting machine, when jamming (sheet jamming) occurs at the cutter of the cutting apparatus, or when metal pieces or the like are engaged with the cutter edge, the cutter edge and parts in a driving system may be damaged when driving force is powerful or the cutter might stop during the operation when driving force is insufficient. In the former case, the cutting apparatus cannot be reused until a cutter with the damaged edge has been replaced. In the latter case, the motor may overheat, and the cutter must be manually returned to a waiting state in order to remove the sheets jammed in the cutter.

In order to prevent such problems from taking place, a torque limiter is mounted on the driving side of the cutting apparatus, or the current of the motor is controlled so as to limit torque transmission. In a system which converts rotational movement into reciprocating movement, however, it is difficult to convert fixed rotational torque into fixed reciprocating torque. The system is not sufficient for inhibiting the torque on the cutter side to less than a fixed amount, since a very high power effect is normally developed in the vicinities of upper and lower dead points.

In order to operate such a system in a more perfect manner, it is therefore desirable to inhibit power transmission at levels less than a fixed level after the rotational movement has been converted into reciprocating movement.

In, for example, Japanese Utility Model Application No. 61-34745 (Japanese Utility Model Unexamined Publication No. 62-147491), a system is proposed utilizing a quadric link system for transmitting rotational movement of a cam to a rotating blade in the form of reciprocating movement by a supporting lever and a spring. For a load exceeding a predetermined amount, the spring is expanded to inhibit the transmission of excessive power.

A disadvantage of the above-noted proposed system resides in the fact that, as is well known, springs expand at a fixed ratio under load and it is impossible to predict any position in a cutting stroke when overload may occur at the reciprocating movable blade of the cutter. Consequently, if overload occurs due to jamming at a position in which the cutter has just started cutting, the above-constructed cutter system is rotated around a driving or motor shaft while the spring is being expanded to a predetermined length. As a result, in addition to the overload generated in the position in which the cutter has just started cutting, the load generated by the expansion of the spring during cutting is transmitted.

On the other hand, if overload occurs at a position in which the cutter is approaching the finish of a cut, the cutter system operates to a limit substantially equal to the power at the occurrence of the overload, since the spring expands a little after the overload has occurred.

In other words, in this system, the magnitude of load that can be inhibited varies in dependence upon the position at which overload occurs, which fact is an obstacle to minimizing power requirements and the driving system.

In this system, if load alternations to be inhibited are decreased, it is effective to reduce the spring constant. If the spring constant is reduced while maintaining predetermined tension, a large-sized spring is required, which results in increased costs and installation space.

SUMMARY OF THE INVENTION

In order to eliminate the foregoing shortcomings, an object of the present invention is to provide a sheet material cutting apparatus on which a simply constructed and small-sized overload preventing device having little power loss is mounted, with the structure of the overload preventing device being such that a shaft is elastically clamped in a groove formed in a connecting lever for driving purposes.

In order to achieve the above object, the sheet material cutting apparatus according to the present invention includes a split groove formed in a connecting lever for power transmission purposes, with a shaft for transmitting the power being elastically fitted into a shaft hole, whereby, when a predetermined load is exceeded, the power transmitting shaft comes off of the shaft hole.

The present invention provides a sheet material cutting apparatus including a pair of blades comprising a movable blade and a fixed blade, with the movable blade being reciprocable for cutting and with a drive device, including a drive arm and a connecting lever with a split groove, being mounted on the sheet material cutting apparatus. The drive device drives the movable blade by the drive arm and the connecting lever, with the drive of the movable blade being controlled by elasticity of the split groove.

The present invention further provides a sheet material cutting apparatus, wherein a drive device, including a connecting lever and a drive arm, is mounted on the sheet material cutting apparatus, and the connecting lever has a split groove and a shaft hole on one end of the split groove, with one end of the connecting lever being rotatably supported by a rotary shaft attached to a rotor. The drive arm has an arm shaft on one end thereof, with the arm shaft being fitted into the shaft hole formed in the connecting lever, and with the other end of the drive arm being secured to the shaft of the movable blade. The drive device is constructed in such a manner that through elasticity of the split groove, the arm shaft is elastically fitted into the shaft hole formed in the connecting lever so as to control the drive of the movable blade.

Furthermore, the present invention provides a sheet material cutting apparatus, wherein a drive device, including a connecting lever and a drive arm, is mounted on the sheet material cutting apparatus, and the connecting lever has a split groove and a shaft hole on one end of the split groove, with one end of the connecting lever being rotatably supported by a rotary shaft attached to a rotor, and the drive arm having an arm shaft on one end thereof. The arm shaft is fitted into the shaft hole formed in the connecting lever, with the other end of the drive arm being secured to the shaft of the movable blade. The drive device is constructed in such a manner that through elasticity of the split groove, the arm shaft is elastically fitted into the shaft hole formed in the connecting lever, and a stop projection is provided at a drive start point of the drive arm so as to stop the drive of the drive arm, thereby returning the arm shaft, which has come out of the shaft hole, to the shaft hole.

Moreover, the present invention provides a sheet material cutting apparatus, wherein a drive device, including a connecting lever and a drive arm, is mounted on the sheet material cutting apparatus, and the connecting lever has a split groove and a shaft hole on one end of the split groove, with one end of the connecting lever being rotatably supported by a rotary shaft attached to a rotor. The drive arm has an arm shaft on one end thereof, with the arm shaft being fitted into the shaft hole formed in the connecting lever, and with the other end of the drive arm being secured to the shaft of the movable blade. The drive device is constructed in such a manner that through elasticity of the split groove, the arm shaft is elastically fitted into the shaft hole formed in the connecting lever, and a guide piece, onto which the connecting lever is slidably fitted, and which rotates around the arm shaft, is provided on the side of the arm shaft of the drive arm.

In addition, the present invention provides a sheet material cutting apparatus, wherein a drive device, including a drive arm and a connecting lever, is mounted on the sheet material cutting apparatus, with the drive arm has a long hole on one end thereof, into which a rotary shaft attached to a rotor is slidably fitted and an arm shaft on the other end thereof. The connecting lever has a split groove and a shaft hole on one end of the split groove, with one end of the connecting lever being rotatably supported by the arm shaft. The drive device is constructed in such a manner that a pin is arranged on the movable blade, and through elasticity of the split groove, the pin is elastically fitted into the shaft hole so as to control the drive of the movable blade.

In the cutter drive device constructed above, even when overload occurs while the movable blade of the cutter is in operation, it is possible to prevent an overload transmission to the cutter side.

DETAILED DESCRIPTION OF THE PREFERRED EMBODIMENTS

Figure 1:
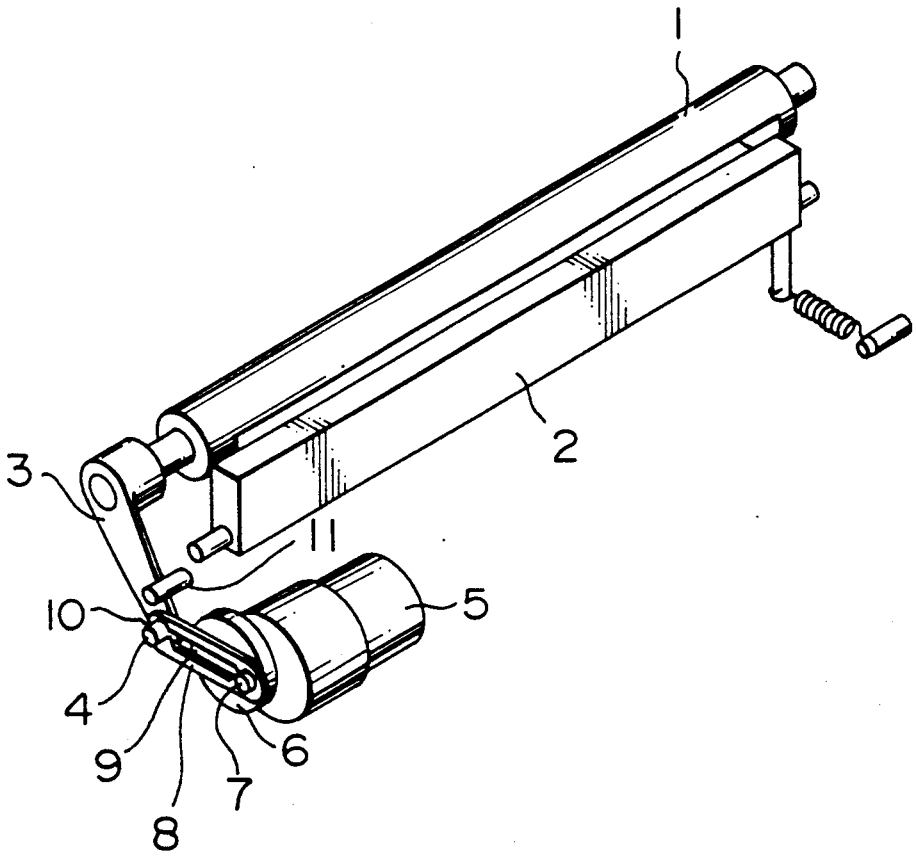
FIG. 1 is a perspective view of an embodiment of a sheet material cutting apparatus acording to the present invention.

Referring now to the drawings wherein like reference numerals are used throughout the various views to designate like parts and, more particularly, to FIG. 1, according to this figure, a cutter, composed of a reciprocable movable blade 1 and a fixed blade 2, has a drive arm 3 attached to the shaft of the movable blade 1, with the edge of the movable blade 1 being pressed into contact with the fixed blade 2. The arm shaft 4 on the end of the drive arm 3 and a rotor shaft 7 are connected to each other by a connecting lever 8 having a split groove 9 with one open end. The rotor shaft 7 is attached to a rotor 6 secured to the shaft of a motor 5.

When the cutter operates under normal conditions, the above system is an ordinary quadric link system. The rotation of the motor 5 is transmitted to the drive arm 3 in the form of reciprocating rotation movement. When the motor 5 rotates one turn, the movable blade 1 performs one operation of cutting and return.

Figure 2A:
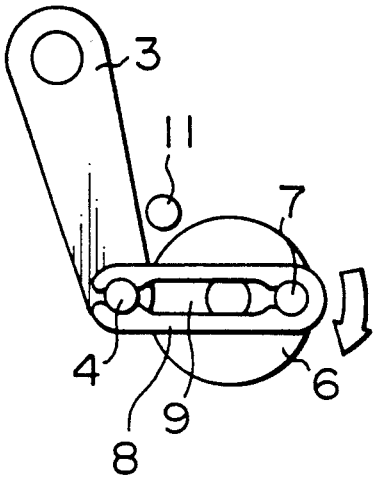
FIGS. 2A through 2D are front views of a drive connecting part showing step by step the operation of the embodiment in FIG. 1.
Figure 2B:
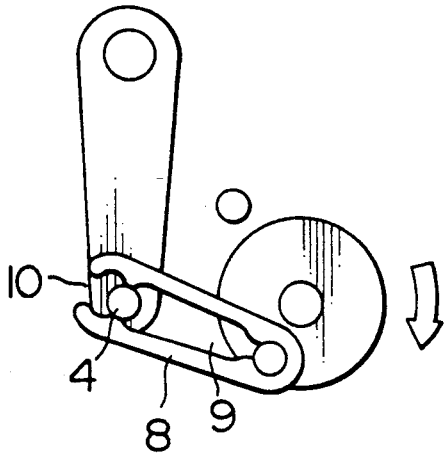
Figure 2C:
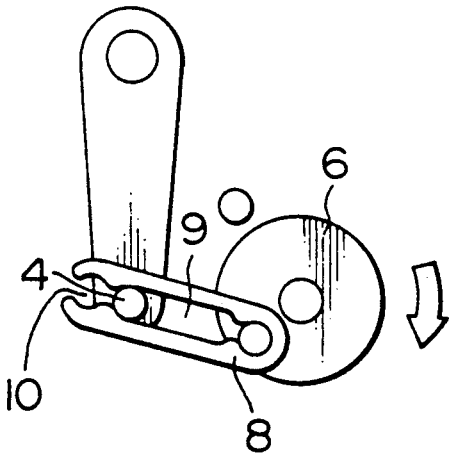
Figure 2D:
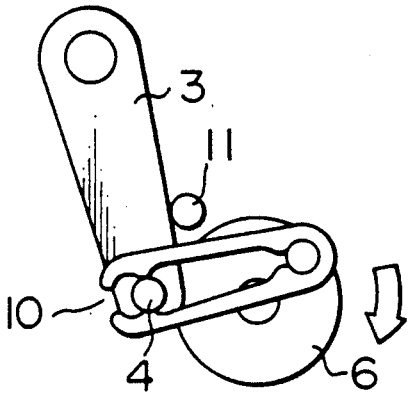

FIGS. 2A through 2D show a series of operations of a cutter drive system of the present invention when the load acting on the cutter portion abnormally increases for reasons such as jamming. FIG. 2A shows a waiting state. When overload occurs, as illustrated in FIG. 2B, a shaft hole 10, which clamps the arm shaft 4 on the end of the drive arm 3 of the connecting lever 8, elastically opens, whereby the arm shaft 4 slips into the split groove of the connecting lever 8. As shown in FIG. 2C, after the arm shaft 4 has slipped into the groove 9, the rotational movement on the motor side is not transmitted to the movable blade 1 because the arm shaft 4 slides in the split groove 9 of the connecting lever 8. Once the rotational position of the rotor 6 reaches a return position, as shown in FIG. 2D, the arm shaft 4 causes the drive arm 3 to start rotating in a return direction. The drive arm 3 comes in contact with a stop projection 11 and stops. The stop projection 11 is being arranged in a position in which the movable blade 1 does not open further from the original waiting position. The drive system returns to its original waiting state due to the fact that the rotation of the rotor 6 pushes the arm shaft 4 to the position of the shaft hole 10.

Even after an overload has occurred, it is thus easy to remove a number of jammed sheets or metal pieces which are attributable to the overload, since the cutter of the sheet material cutting apparatus according to the present invention stops in the original waiting position.

Furthermore, even when overload occurs at any position of the cutter, the magnitude of a cutting-off critical load can be substantially constant. The power of the motor and the strength of the drive system can be appropriately designed in accordance with the above critical load.

Figure 3:
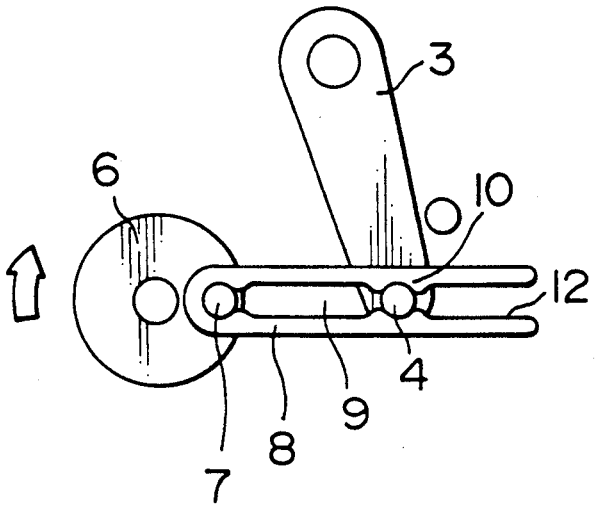
FIGS. 3 and 4 are front views respectively illustrating other embodiments of the invention.

In FIG. 3, the drive arm 3 of the movable blade and the rotor 6 on the side of a driving shaft are connected to each other by the connecting lever 8 which has the split groove 9. The drive arm 3 is driven in the direction in which it is drawn by the rotor 6 with the aid of the connecting lever 8. When an overload occurs under such conditions, since the arm shaft 4 slides toward the outside of the connecting lever 8, a guide portion 12 is arranged on the end of the connecting lever 8 so that the arm shaft 4, at its return position, is capable of returning to a predetermined position of the shaft hole 10 formed in the connecting lever 8.

In the above case, because the drive arm 3 can be driven in a direction in which it is drawn, together with the embodiment shown in FIG. 1, the design of the drive system can be either one in which the drive arm 3 is pushed toward the side of the driving shaft, or one in which the drive arm 3 is drawn from the driving shaft.

Figure 4:
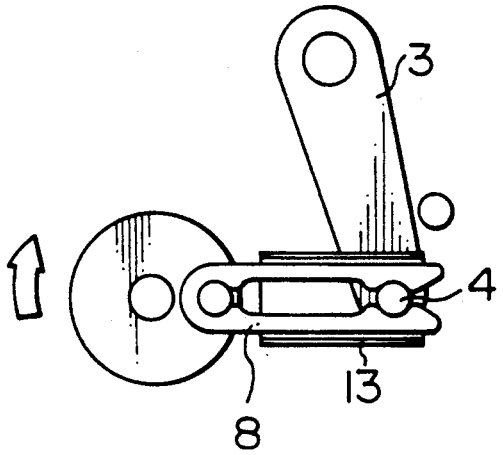

In FIG. 4, a guide piece 13, of a C-shaped cross section, is attached to the arm shaft 4 of the drive arm 3.

The guide piece 13 serves to return the connecting lever 8, which has come off when overload occurs, and the arm shaft 4 to the original state. When the above system is used in the embodiment shown in FIG. 3, since the guide portion 12 arranged in the connecting lever 8 does not reciprocate while the guide portion 12 is extended, the sheet material cutting apparatus of the present invention may be smaller.

Figure 5:
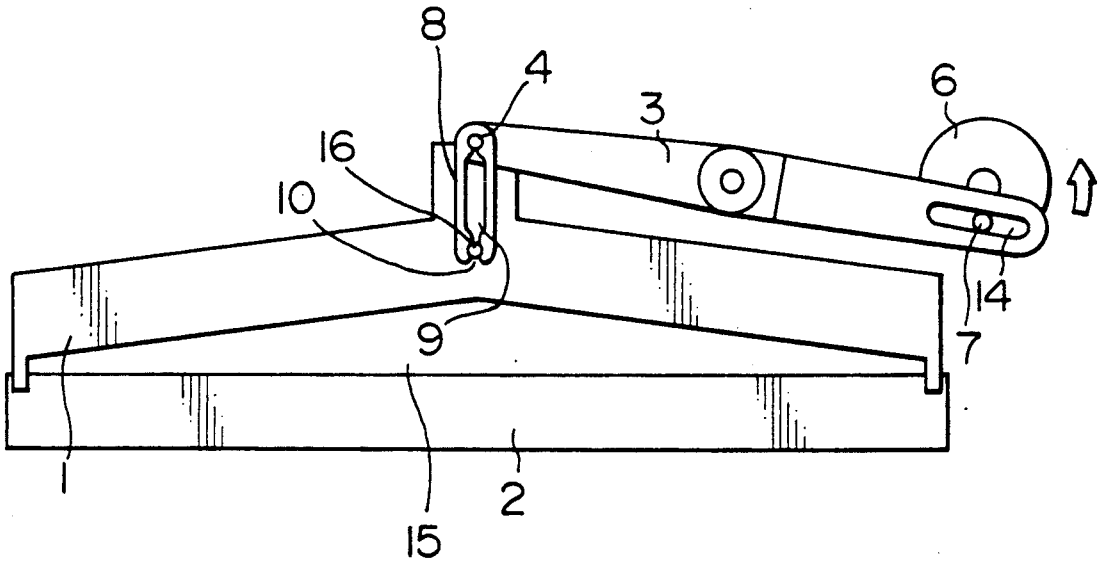
FIG. 5 is a schematic front view illustrating a further embodiment of the invention.

The embodiment of FIG. 5 is a guillotine cutter which is made up of the fixed blade 2 having a straight edge and the movable blade 1 which has a V-shaped edge, and which reciprocates up and down. In FIG. 5, the rotational movement of the rotor 6, driven by a motor (not shown), is transmitted to a pin 16 through the drive arm 3 and the connecting lever 8 which has a split groove. The rotational movement of the rotor 6 is converted into reciprocating movement of the movable blade 1.

When an overload occurs due to the fact that a large number of sheets are inserted into the space 15 between the movable blade 1 and the fixed blade 2, the motor is not overheated and it is easy to remove the jammed sheets, as compared with a case where the drive arm 3 is directly connected to the movable blade 1. This is because the movable blade 1 returns to the original waiting position after the action of the connecting lever 8 has automatically avoided the overload on the side of the motor.

In the embodiment of FIG. 5, although a description has been given of a case where the shaft hole 10, formed in the connecting lever 8, is fitted around the pin 16 of the movable blade 1, the same operation is expected even if the connecting lever 8 is arrange in the direction opposite to the direction shown in FIG. 5, and if the shaft hole 10 is fitted around the arm shaft 4. The connecting lever 8 can thus be arranged in either direction, depending upon its use applications. The above holds true for the embodiment illustrated in FIG. 1.

What is claimed is:

1. A sheet material cutting apparatus comprising a movable blade and a fixed blade, drive means for reciprocably driving the movable blade, said drive means including a connecting lever, a drive arm having a first end connected to said movable blade and a second end having an arm shaft, an elastically deformable groove provided in said connecting lever, a rotary shaft for connecting one end of said connecting lever to a rotor, and hole means formed in said connecting lever for receiving said arm shaft, and wherein said arm shaft is elastically fitted into said hole means whereby, upon an occurrence of an overload condition in the cutting apparatus, the arm shaft is displaced out of said hole means so as to interrupt the drive of said movable blade.

2. A sheet material cutting apparatus comprising a movable blade and a fixed blade, drive means for reciprocably driving the movable blade for enabling a cutting operation, wherein said drive means includes a drive arm, a connecting lever an elastically deformable groove provided in said connected lever, and means accommodated in said groove for elastically deforming said groove upon an occurrence of an overload condition in the cutting apparatus so as to interrupt the drive of said movable blade.

3. A sheet material cutting apparatus comprising a movable blade and a fixed blade, drive means for reciprocably driving the movable blade, wherein said drive means includes a drive arm, a connecting lever, a drive arm having a first end connected to said movable blade and a second end having an arm shaft, an elastically deformable groove provided in said connecting lever, a rotary shaft for connecting one end of said connecting lever to a rotor, hole means formed in said connecting lever for receiving said arm shaft, wherein said arm shaft is elastically fitted into said hole means whereby, upon an occurrence of an overload condition in the cutting apparatus, the shaft is displaced out of said hole means so as to interrupt the drive of said movable blade, and wherein a stop projection means is provided for defining a drive start point of said drive arm, said stop projection means being adapted to stop the drive of said drive arm and return the arm shaft to said hole means.

4. A sheet material cutting apparatus comprising a movable blade and a fixed blade, drive means for reciprocably driving the movable blade, said drive means includes a connecting lever, a drive arm having a first end connected to said movable blade and a second end having an arm shaft, an elastically deformable groove provided in said connecting lever, a rotary shaft for connecting one end of said connecting lever to a rotor, hole means formed in said connecting lever for receiving said arm shaft, wherein said arm shaft is elastically fitted into said hole means, whereby, upon occurrence of an overload condition in the cutting apparatus, the arm shaft is displaced out of said hole means so as to interrupt the drive of said movable blade, and wherein a guide means, mounted for rotation around said arm shaft is provided for slidably guiding said connecting lever so as to enable said arm shaft to be returned to said hole means upon an elimination of the overload condition of the cutting apparatus.

5. A sheet material cutting apparatus comprising a movable blade and a fixed blade, drive means for reciprocably driving the movable blade, said drive means includes a connecting lever, a drive arm having an elongated hole on a first end thereof and an arm shaft on an opposite end thereof for rotatably supporting said connecting lever, a rotary shaft attached to a rotor and slidably fitted into said elongated hole, an elastically deformable groove formed in said connecting lever, hole means formed at one end of said groove, and a pin arranged on said movable blade and elastically fitted into said hole means, whereby, upon an occurrence of an overload condition in the cutting apparatus, said pin is displaced out of said hole means so as to interrupt the drive of said movable blade.

* * * * *